US007150058B2

(12) United States Patent
Rabska et al.

(10) Patent No.: US 7,150,058 B2
(45) Date of Patent: Dec. 19, 2006

(54) ASSIST HANDLE ASSEMBLY FOR BEDS

(75) Inventors: Kevin Rabska, Plover, WI (US); Todd C. Kramer, Stevens Point, WI (US)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 10/762,407

(22) Filed: Jan. 22, 2004

(65) Prior Publication Data

US 2004/0168254 A1 Sep. 2, 2004

Related U.S. Application Data

(60) Provisional application No. 60/450,786, filed on Feb. 28, 2003.

(51) Int. Cl.
*A47C 21/08* (2006.01)

(52) U.S. Cl. ..... 5/662; 5/503.1; 5/425; 5/430

(58) Field of Classification Search ..... 5/662, 5/658, 503.1, 424, 425, 428, 430
See application file for complete search history.

(56) References Cited

U.S. PATENT DOCUMENTS

| | | | | | |
|---|---|---|---|---|---|
| 1,778,698 | A | * | 10/1930 | Walter | 5/602 |
| 2,817,855 | A | * | 12/1957 | Pratt | 5/430 |
| 3,179,957 | A | * | 4/1965 | Norton | 5/428 |
| 3,220,024 | A | * | 11/1965 | Nelson | 5/429 |
| 3,286,283 | A | * | 11/1966 | Bertoldo | 5/662 |
| 3,747,133 | A | * | 7/1973 | Hutt | 5/429 |
| 3,971,083 | A | * | 7/1976 | Peterson | 5/430 |
| 4,959,878 | A | | 10/1990 | Essek | 5/424 |
| 5,060,327 | A | * | 10/1991 | Celestina et al. | 5/662 |
| 5,069,465 | A | * | 12/1991 | Stryker et al. | 280/47.371 |
| 5,216,768 | A | | 6/1993 | Bodine et al. | 5/711 |
| 5,231,721 | A | | 8/1993 | Fish | 5/662 |
| 5,335,385 | A | | 8/1994 | Brown | 5/662 |
| 5,337,430 | A | | 8/1994 | Schlein | 5/662 |
| 5,381,571 | A | | 1/1995 | Gabhart | 5/430 |
| 5,384,927 | A | | 1/1995 | Mardero et al. | 5/662 |
| 5,388,294 | A | | 2/1995 | Reeder | 5/600 |
| 5,394,581 | A | | 3/1995 | Leoutsakos | 5/662 |
| 5,418,988 | A | | 5/1995 | Iura | 5/430 |
| 5,485,699 | A | | 1/1996 | Gabhart | 49/394 |
| 5,678,267 | A | | 10/1997 | Kinder | 5/662 |
| 5,689,839 | A | | 11/1997 | Laganiére et al. | 5/425 |
| 5,781,945 | A | | 7/1998 | Scherer et al. | 5/426 |
| 5,802,636 | A | | 9/1998 | Corbin et al. | 5/425 |
| 5,806,111 | A | | 9/1998 | Heimbrock et al. | 5/86.1 |
| 5,832,549 | A | | 11/1998 | Le Pallec et al. | 5/430 |
| 6,058,531 | A | | 5/2000 | Carroll | 5/430 |
| 6,076,209 | A | * | 6/2000 | Paul | 5/617 |
| 6,240,583 | B1 | | 6/2001 | Brooke et al. | 5/662 |
| 6,397,416 | B1 | * | 6/2002 | Brooke et al. | 5/662 |
| 6,427,264 | B1 | | 8/2002 | Metz et al. | 5/425 |
| 6,668,402 | B1 | * | 12/2003 | Heimbrock | 5/600 |

(Continued)

*Primary Examiner*—Robert G. Santos
(74) *Attorney, Agent, or Firm*—MacMillan, Sobanski & Todd, LLC

(57) ABSTRACT

An assist handle can easily be retrofit to the sleep surface frame of an existing articulating bed. The handle comprises an assist handle, a handle mount that is adapted to be supported by the bed for supporting the assist handle for movement relative to the bed, and one or more latch configurations for latching the assist handle in one or more fixed positions relative to the bed.

29 Claims, 6 Drawing Sheets

U.S. PATENT DOCUMENTS

| | | | | |
|---|---|---|---|---|
| 6,691,350 | B1 * | 2/2004 | Weismiller | 5/621 |
| 6,728,985 | B1 * | 5/2004 | Brooke et al. | 5/662 |
| 6,789,280 | B1 * | 9/2004 | Paul | 5/425 |
| 6,829,793 | B1 * | 12/2004 | Brooke et al. | 5/425 |
| 7,039,971 | B1 * | 5/2006 | Sebastien | 5/662 |
| 2001/0027578 | A1 * | 10/2001 | Brooke et al. | 5/662 |
| 2002/0095728 | A1 * | 7/2002 | Weismiller | 5/503.1 |
| 2003/0024048 | A1 * | 2/2003 | Heimbrock | 5/600 |
| 2003/0056293 | A1 * | 3/2003 | Brooke et al. | 5/662 |
| 2004/0168254 | A1 * | 9/2004 | Rabska et al. | 5/662 |
| 2005/0120485 | A1 * | 6/2005 | Sebastien | 5/662 |
| 2006/0130238 | A1 * | 6/2006 | Smith | 5/662 |
| 2006/0130239 | A1 * | 6/2006 | Smith | 5/662 |

* cited by examiner

ASSIST HANDLE ASSEMBLY FOR BEDS

CROSS REFERENCE TO RELATED APPLICATIONS

This application is a continuation of U.S. Provisional Patent Application No. 60/450,786, filed on Feb. 28, 2003.

BACKGROUND OF INVENTION

This invention relates generally to beds and, more particularly, to convalescent beds. Most particularly, the invention relates to an assist handle assembly for use with articulated beds.

Assists handles are well known. Such handles are typically associated with beds to aid an occupant in entering and exiting the bed. Some assist handles function as guardrails to prevent the bed occupant from falling out of the bed. A popular convalescent bed has a sleep surface frame that can be articulated between elevated and lowered positions. The sleep surface typically includes head, knee and foot sections that can be raised and lowered independently of one another. On such a bed, it is desirable that the assist device be attached to the sleep surface frame so that the device moves with the frame as the surface is articulated.

What is needed is an assist handle assembly that can easily be retrofit to the sleep surface frame of an existing articulating bed.

SUMMARY OF INVENTION

The present invention is directed towards an assist handle that can easily be retrofit to the sleep surface frame of an existing articulating bed. The handle comprises an assist handle, a handle mount that is adapted to be supported by the bed for supporting the assist handle for movement relative to the bed, and one or more latch configurations for latching the assist handle in one or more fixed positions relative to the bed.

Various objects and advantages of this invention will become apparent to those skilled in the art from the following detailed description of the preferred embodiment, when read in light of the accompanying drawings.

DETAILED DESCRIPTION

Figure 1:
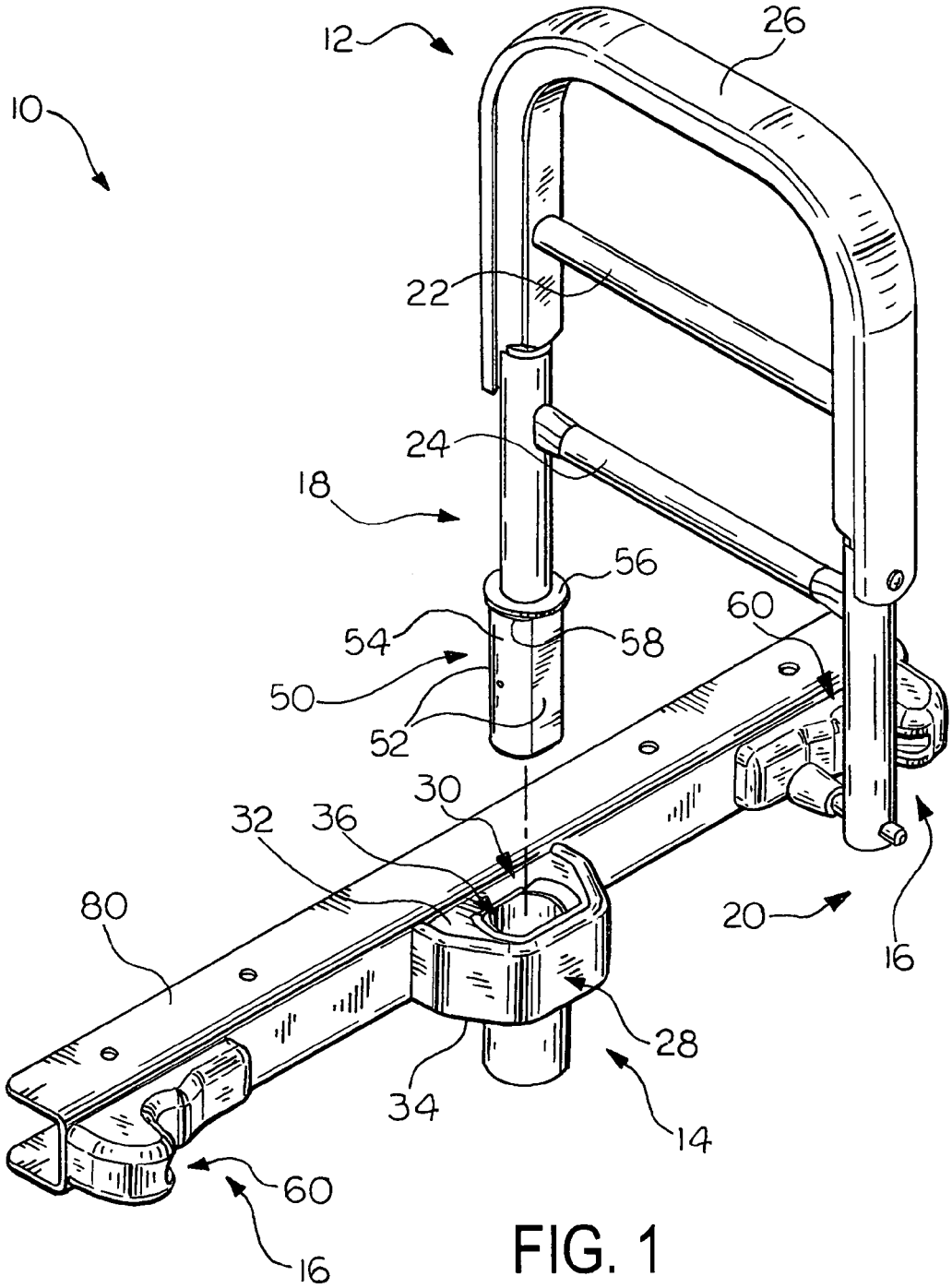
FIG. 1 is an exploded perspective view of an assist handle assembly according to the present invention.
Figure 6:
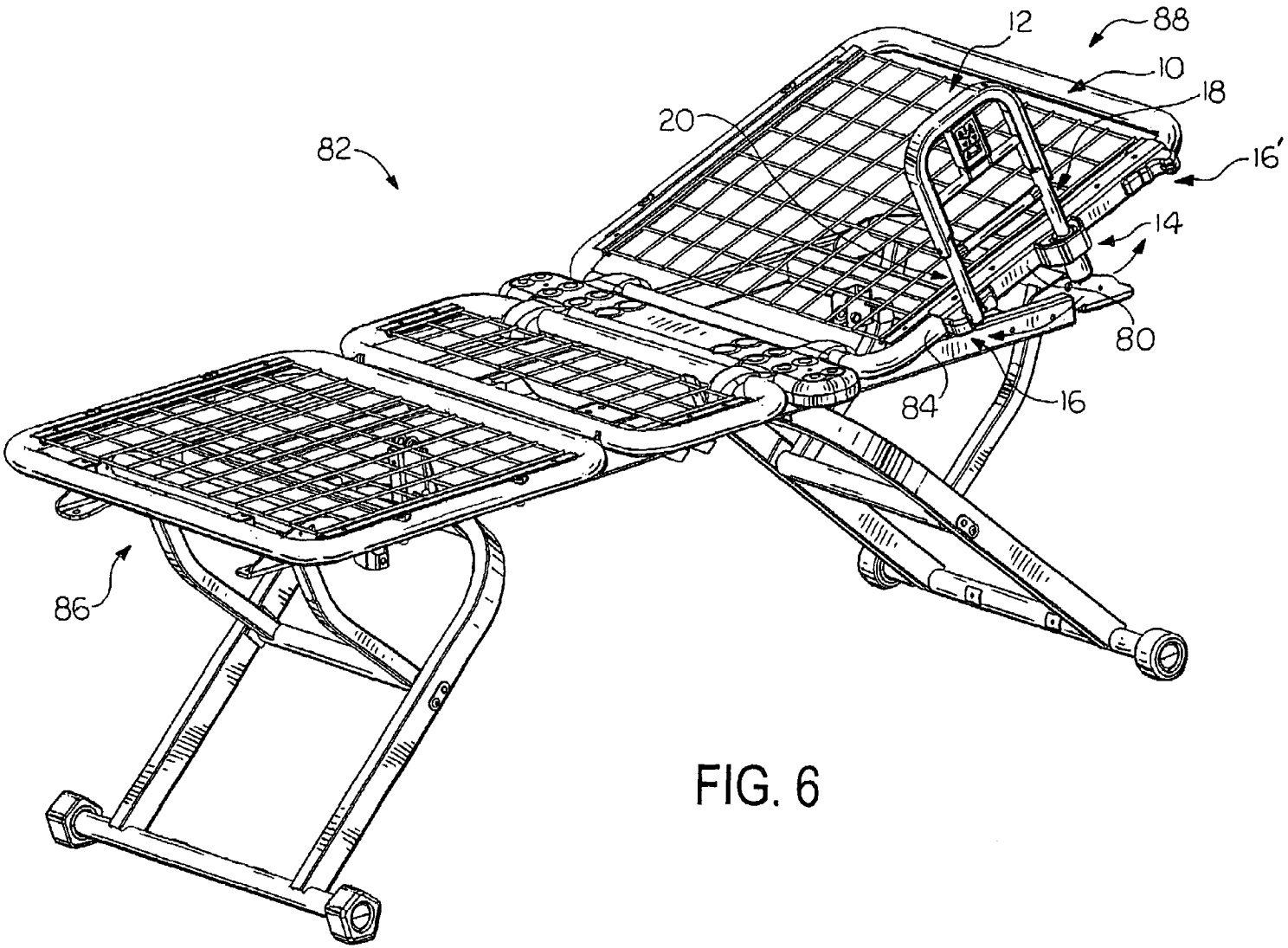
FIG. 6 is a reduced scale perspective view of the assist handle assembly supported by an articulated bed.

Now with reference to the drawings, there is illustrated in FIG. 1 an assist handle assembly, generally indicated at 10, in accordance with the present invention. The assist handle assembly 10 is adapted to be attached to the frame 84 of an articulated bed 82, as shown in FIG. 6. The assist handle assembly 10 according to the invention includes an assist handle 12 and a handle mount 14 for supporting the assist handle 12 for movement relative to the bed 82. The assist handle assembly 10 further includes one or more latch configurations 16 for latching the assist handle 12 in one or more fixed positions relative to the bed 82.

The assist handle 12 may be any form of assist device. However, in accordance with a preferred embodiment of the invention, the assist handle 12 has at least two spaced apart members, wherein a first member 18 and a second member 20 that orbits about the first member 18 when the assist handle 12 is moved relative to the handle mount 14. For example, the assist handle 12 can be in the form of an inverted U-shaped tubular structure, as illustrated in FIG. 1, and the spaced apart members 18, 20 may be defined by legs of the U-shaped structure. Cross members 22, 24 may be provided for improving the rigidity of the assist handle 12 and maintaining the relative positions of the spaced apart members 18, 20. In accordance with the most preferred embodiment of the invention, the assist handle 12 is made of metal and the cross members 22, 24 are welded between the spaced apart members 18, 20 to form a weldment of unitary construction. To provide insulation from the cold metal, a grip 26 can be applied to the assist handle 12. The grip 26 is most preferably applied to the outer surface of the assist handle 12, as shown in FIG. 1.

Figure 2:
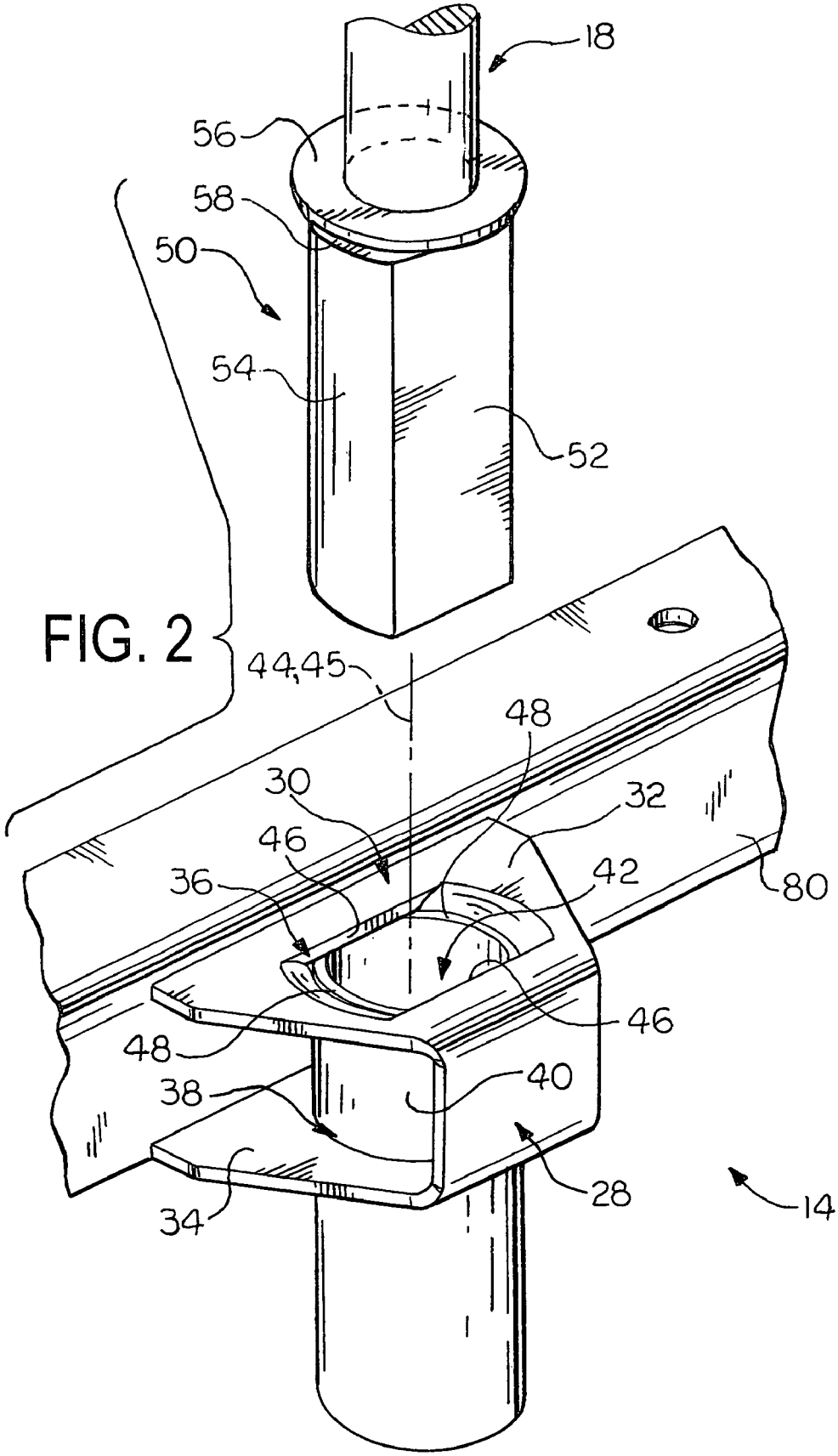
FIG. 2 is an enlarged exploded perspective view of a configuration for mounting the assembly shown in FIG. 1.
Figure 3:
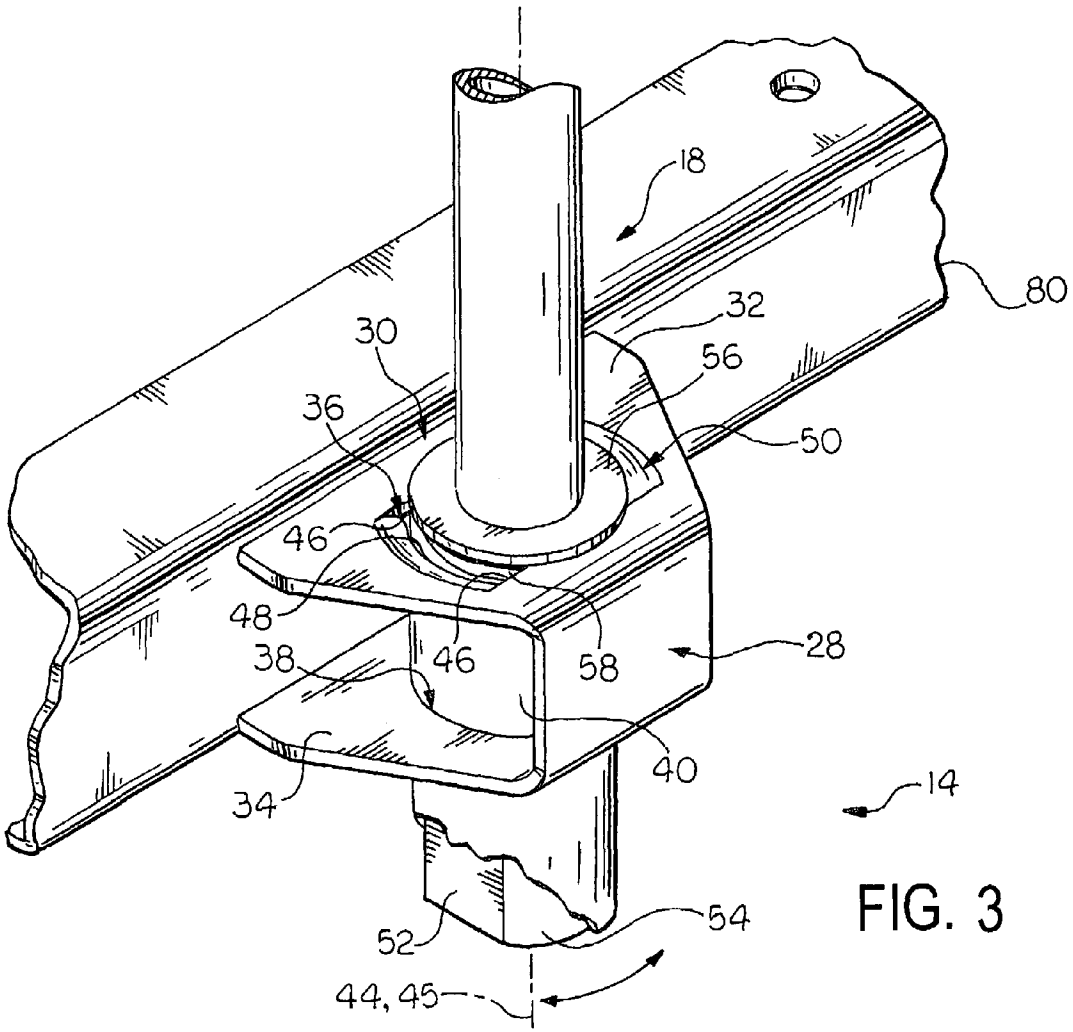
FIG. 3 is an assembled perspective view of the mounting configuration shown in FIG. 1.
Figure 4:
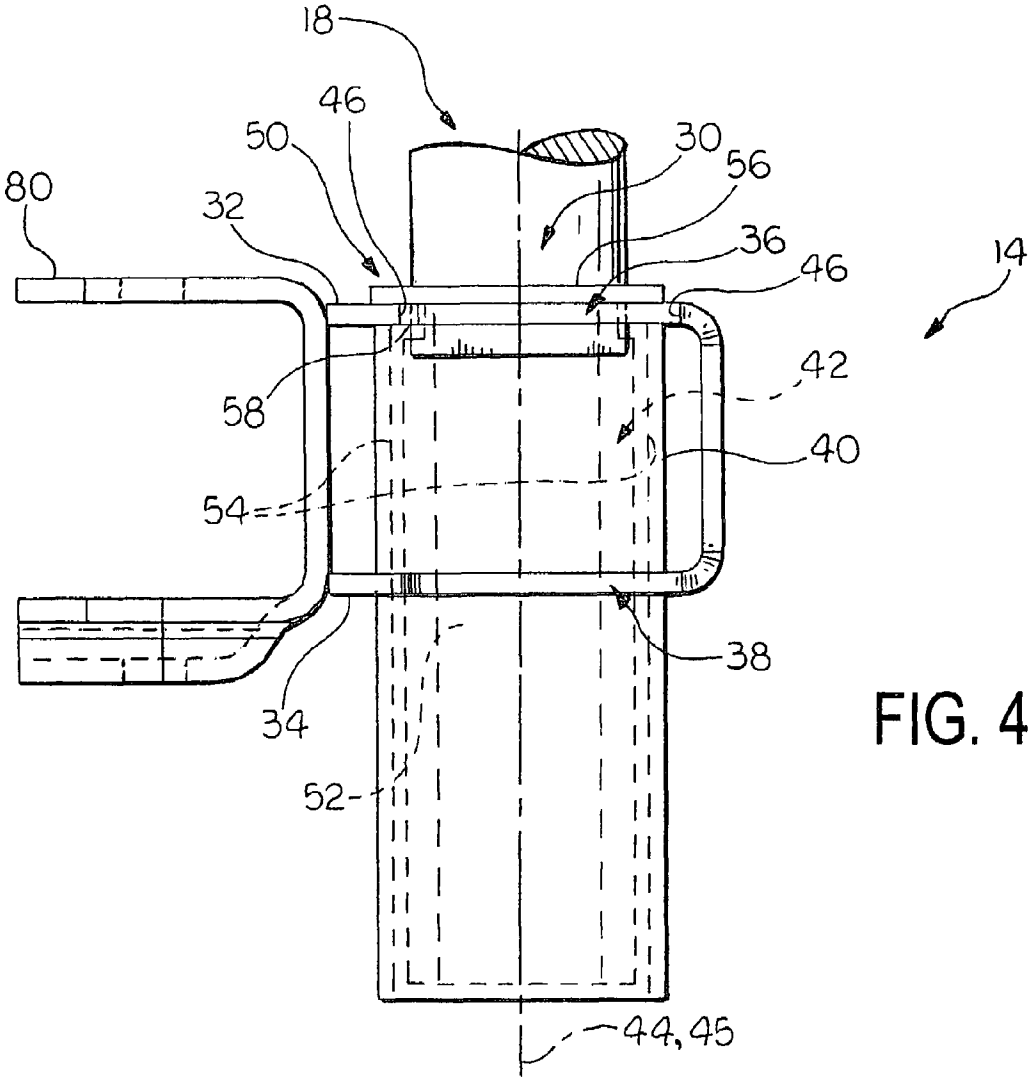
FIG. 4 is a sectional view in elevation of the mounting configuration shown in FIG. 3.

The handle mount 14 includes a bracket 28 that is adapted to be supported by the bed 82, most preferably by the sleep surface frame 84 of the bed 82. The bracket 28 has a hole 30 therein for receiving the first member 18 of the assist handle 12. The handle mount 14 may include one or more plates and most preferably includes an upper plate 32 and a lower plate 34 spaced apart from the upper plate 32. The plates 32, 34 have aligning holes 36, 38 therein, as shown more clearly in FIGS. 2–4. A generally cylindrical sleeve 40 is supported relative to the handle mount 28. The sleeve 40 has a passage 42 therethrough. The passage 42 has a central axis 44 that is coincident with the central axis 45 of the hole 30. In a preferred embodiment of the invention, the upper plate 32 is stamped with portions thereof folded down to provide radial support of the sleeve 40. The hole 36 in the upper plate 32 is preferably an irregular-shaped hole and is most preferably defined by at least one flat side, although opposing flat sides 46 are shown, and a curved side, though opposing curved sides 48 are shown. The hole 38 in the lower plate 34 is preferably generally cylindrical in shape. Hence, the sleeve 40 can be inserted in the hole 38 in the lower plate 34 until it engages the upper plate 32 and then is welded or otherwise secured to the handle mount 14.

The assist handle 12 has a member 50 that is adapted to mate with the hole 30 in the handle mount 14. The mating member 50 can be made of plastic and affixed to the first member 18 of the assist handle 12. The mating member 50 preferably has flats 52 and curved surfaces 54 that correspond to the flat sides 46 and curved sides 48 defining the hole 36 in the upper plate 32. A radially extending generally cylindrical flange 56 is disposed above the mating member 50. A partial annular groove 58 is defined between the curved surfaces 54 and the flange 56. The flange 56 restricts the travel of the first member 18 of the assist handle 12 through the sleeve 40. The annular groove 58 is sized to receive the flat sides 46 defining the hole 36 in the upper plate 32. Upon inserting the mating member 50 in the hole 36 and rotating the assist handle 12, the flat sides 46 are trapped in the annular groove 58 and the curved sides 48 interfere with the flat sides 46 to prevent the mating member 50 from being removed from the hole 36.

It should be appreciated that the hole 36 and the mating member 50 may be any suitable shape to interlock the assist handle 12 and the handle mount 14. Although the interlocking structure is preferred, it should be understood by those of ordinary skill in the art of the invention that the hole 36 and mating member 50 can be generally cylindrical or some other shape that does not result in an interlocking relationship therebetween.

Figure 5:
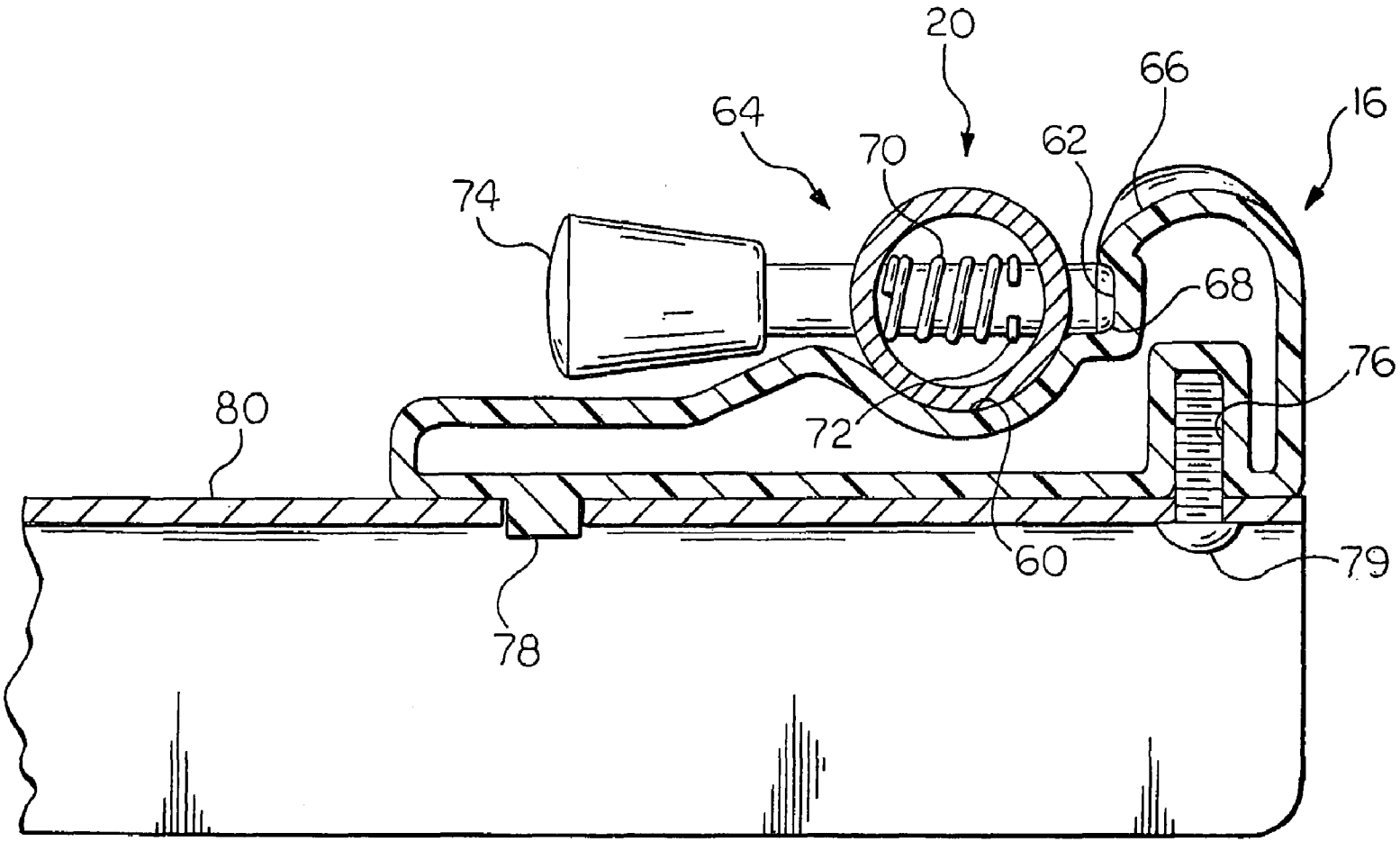
FIG. 5 is a partially cutaway bottom plan view of a configuration for latching the assist handle in a fixed position.

The second member 20 of the assist handle 12 is adapted to cooperate with the latch configurations 16 to latch the assist handle 12 in one or more fixed positions. The latch configuration 16 can be any suitable latch device. For example, the latch configuration 16 can include a receiver 60 for receiving the second member 20, as shown in FIG. 5. A detent or hole 62 may be provided proximate the receiver 60. The second member 20 can be provided with a locking pin 64 that is releasably engageable with the hole 62 to hold the second member 20 in the receiver 60. In a preferred embodiment of the invention, the latch configuration 16 has a ramp or cam surface 66 upon which the pin 64 engages as the second member 20 of the assist handle 12 enters the receiver 60. As the pin 64 engages the cam surface 66, the pin 64 is urged in a first direction, or toward the first member 18 of the assist handle 12 (i.e., to the left when viewing FIG. 5). In a preferred embodiment of the invention, the pin 64 has a ball end 68 to encourage a smooth engagement between the pin 64 and the cam surface 66. The hole 62 for receiving the pin 64 is adjacent the highest portion of the cam surface 66. When the second member 20 of the assist handle 12 completely enters the receiver 60, the pin 64 passes the highest portion of the cam surface 66 and plunges into the hole 62 (i.e., to the right when viewing FIG. 5). The pin 64 is preferably urged into the hole 62 by a spring 70, as shown in FIG. 5. The spring 70 is located inside the second member 20 of the assist handle 12 between a stop member, such as the E-clip 72 shown, and an inner surface of the second member 20. To unlatch the assist handle 12, the pin 64 is withdrawn from the hole 62 merely by pulling the pin 64 in a direction opposite the force of the spring 70 (i.e., to the left when viewing FIG. 5). To aid in pulling the pin 64, a knob 74 can be provided on the pin 64 opposite the ball end 68.

In a preferred embodiment of the invention, the latch configurations 16 are made of a rigid plastic, preferably by injection molding. The latch configurations 16 have a back side, which preferably has a threaded hole 76 therein and a tab 78 extending therefrom. A threaded member 79 engages the threaded hole 76 to secure the latch configuration 16 to a supporting surface. The tab 78 prevents the latch configuration 16 from pivoting on the threaded member 79.

The handle mount 14 is preferably secured to a mounting channel 80 with a latch configuration 16 disposed on the channel 80 at opposing sides of the mount 14, as shown in FIG. 6. The assist handle 12 is adapted to pivot or rotate about the first member 18 thereof. The assist handle 12 pivots in a first direction (i.e., clockwise when viewing FIG. 6) to engage a first latch configuration 16 in a first position, as shown in FIG. 6, and about 180-degrees from the first position in a second direction (i.e., counter-clockwise when viewing FIG. 6) to engage a second latch configuration 16' in a second position. In the first position, toward the foot end 86 of the bed 82, the assist handle 12 functions as an assist device. In the second position, toward the head end 88 of the bed 82, the assist handle 12 is out of the way to permit an occupant to enter and exit the bed 82 with relative ease. The channel 80 is adapted to be mounted to the frame of the bed 82, most particularly to the sleep surface frame 84, as illustrated in FIG. 6.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An assist handle assembly for use on an articulating bed, the assembly comprising:

an assist handle;

a handle mount that is adapted to be supported by the bed for supporting the assist handle for movement relative to the bed, the assist handle being readily removable from the handle mount without the aid of tools, the assist handle having a first member and a second member that orbits about the first member when the assist handle is moved relative to the handle mount; and a plurality of latch configurations for latching the assist handle in a plurality of fixed positions relative to the bed.

2. The assembly according to claim 1 wherein the assist handle is an inverted U-shaped tubular structure and the first and second members are defined by legs of the U-shaped structure.

3. The assembly according to claim 2, further comprising one or more cross members extending between the first and second members.

4. The assembly according to claim 1, further comprising a grip applied to the assist handle.

5. The assembly according to claim 1, wherein each latch configuration includes a receiver for receiving a member of the assist handle and a hole and the member of the assist handle supports a locking pin that is releasably engageable with the hole to hold the member in the receiver.

6. The assembly according to claim 5, wherein each latch configuration further comprises a cam surface which the pin engages as the assist handle enters the receiver to urge the pin in a first direction until the assist handle completely enters the receiver, at which point the pin plunges into the hole.

7. The assembly according to claim 6, wherein the pin has a ball end to encourage a smooth engagement between the pin and the cam surface.

8. The assembly according to claim 6, wherein the pin is urged in a second direction opposite the first direction by a spring to urge the pin into the hole.

9. An assist handle assembly for use on an articulating bed, the assembly comprising:

an assist handle;

a handle mount that is adapted to be supported by the bed for supporting the assist handle for movement relative to the bed, the handle mount including a bracket, the handle mount being adapted to be supported by the bed by the bracket, the handle mount further including a plate having a hole therein and a generally cylindrical sleeve supported relative to the plate with a passage therethrough that aligns with the hole, the assist handle being readily removable from the handle mount without the aid of tools; and a plurality of latch configurations for latching the assist handle in a plurality of fixed positions relative to the bed.

10. The assembly according to claim 9, wherein the hole has an irregular shape and the assist handle has a member that mates with the hole.

11. The assembly according to claim 10, wherein the hole is defined by at least one flat side and a curved side.

12. The assembly according to claim 10, wherein the hole is defined by two opposing flat sides and two opposing curved sides.

13. The assembly according to claim 12, wherein the mating member of the assist handle has flat surfaces and curved surfaces that correspond to the flat sides and the curved sides defining the hole in the plate.

14. An assist handle assembly for use on an articulating bed, the assembly comprising:

an assist handle;

a handle mount for supporting the assist handle for movement relative to the bed, the handle mount being supported by the bed via a bracket, the handle mount including a plate having a hole therein and a generally cylindrical sleeve supported relative to the plate with a passage therethrough that aligns with the hole in the plate, the hole in the plate being defined by two opposing flat sides and two opposing curved sides that mate with a mating member of the assist handle having flat surfaces and curved surfaces that correspond to the flat sides and the curved sides defining the hole in the plate; the assist handle further having a flange that is disposed above the mating member and a partial annular groove defined between the curved surfaces and the flange, the annular groove being sized to receive the flat sides defining the hole in the plate upon inserting the mating member in the hole and rotating the assist handle to trap the mating member in the hole; and one or more latch configurations for latching the assist handle in one or more fixed positions relative to the bed.

15. An assist handle assembly for use on an articulating bed, the assembly comprising:

an assist handle;

a handle mount that is adapted to be supported by the bed for supporting the assist handle for movement relative to the bed, the assist handle being readily removable from the handle mount without the aid of tools, the handle mount being secured to a mounting channel; and a plurality of latch configurations for latching the assist handle in a plurality of fixed positions relative to the bed, the latch configurations including a latch configuration disposed on the channel at opposing sides of the mount, the assist handle being adapted to pivot in a first direction to engage a first one of the latch configurations in a first position and about 180-degrees in a second direction to engage a second one of the latch configurations in a second position.

16. The assembly according to claim 15, wherein the channel is structured to be mounted to the bed.

17. An assist handle assembly for use on an articulating bed, the assembly comprising:

an assist handle;

a handle mount that is adapted to be supported by the bed for supporting the assist handle for movement relative to the bed, the assist handle being readily removable from the handle mount without the aid of tools, the assist handle has having two spaced members including a first member that is rotatable relative to the handle mount and a second member that orbits about the first member as the first member is rotated relative to the handle mount; and a plurality of latch configurations spaced from the handle mount for latching the assist handle in a plurality of fixed positions relative to the bed.

18. The assembly according to claim 17, wherein the assist handle is an inverted U-shaped structure having legs with free ends defining the first and second members of the assist handle.

19. The assembly according to claim 18, further comprising a cross member extending between the legs and being vertically positioned between the free ends of the legs and an upper end of the U-shaped structure.

20. The assembly according to claim 17, further comprising a grip applied to the assist handle, the grip being insulative to insulate a user from the assist handle.

21. An assist handle assembly for use on an articulating bed, the assembly comprising:

an assist handle;

a handle mount that is adapted to be supported by the bed for supporting the assist handle for movement relative to the bed, the handle mount comprising a plate having a hole therein and a sleeve having a passage therethrough that aligns with the hole to receive a first member of the assist handle, the assist handle being readily removable from the handle mount without the aid of tools; and a plurality of latch configurations spaced from the handle mount for latching the assist handle in a plurality of fixed positions relative to the bed.

22. The assembly according to claim 21, wherein the hole in the plate has an irregular shape and the first member of the assist handle has at least a partial annular groove that rotationally interlocks with the irregular shape of the hole in the plate to prevent removal of the first member of the assist handle from the hole in the plate.

23. The assembly according to claim 22, wherein the hole in the plate has one or more flat sides and one or more curved sides and the first member of the assist handle has one or more flat surfaces and one or more curved surfaces that mate with the one or more flat sides and one or more curved sides of the hole in the plate.

24. The assembly according to claim 22, wherein the first member of the assist handle further has a radial flange that partially defines the partial annular groove and restricts vertical travel of the first member of the assist handle through the hole in the plate.

25. An assist handle assembly for use on an articulating bed, the assembly comprising:

an assist handle;

a handle mount that is adapted to be supported by the bed for supporting the assist handle for movement relative to the bed;

an interlock that permits insertion of a first member of the assist handle into the handle mount when in a first position and prevents removal of the first member of the assist handle from the handle mount when rotated to a second position so that the assist handle is readily removable from the handle mount without the aid of tools; and a plurality of latch configurations spaced from the handle mount for latching the assist handle in a plurality of fixed positions relative to the bed.

26. An assist handle assembly for use on an articulating bed, the assembly comprising:

an assist handle;

a handle mount that is adapted to be supported by the bed for supporting the assist handle for movement relative to the bed, the assist handle being readily removable from the handle mount without the aid of tools; and;

a plurality of latch configurations spaced from the handle mount for latching the assist handle in a plurality of fixed positions relative to the bed, latch configurations comprising:

a receiver for receiving a member of the assist handle and having a portion shaped complementary to the member of the assist handle;

a detent transverse to the receiver, the member of the assist handle having a pin that is releasably engageable with the detent to hold the member in the receiver; and a ramp surface, the pin being engageable with the ramp surface to urge the pin in a first direction until the assist handle is in the receiver and the pin enters the detent.

27. The assembly according to claim 26, further comprising a spring for urging the pin into the detent.

28. An assist handle assembly for use on an articulating bed, the assembly comprising:

an assist handle;

a handle mount that is adapted to be supported by the bed for supporting the assist handle for movement relative to the bed, the assist handle being readily removable from the handle mount without the aid of tools; and;

a plurality of latch configurations spaced from the handle mount for latching the assist handle in a plurality of fixed positions relative to the bed, latch configurations comprising:

a receiver for receiving a member of the assist handle and having a portion shaped complementary to the member of the assist handle;

a detent transverse to the receiver, the member of the assist handle having a pin that is releasably engageable with the detent to hold the member in the receiver; and a threaded hole and a tab spaced from the threaded hole, the threaded hole being provided for receiving a threaded fastener for securing the latch configurations to a supporting surface and the tab engages a hole in the supporting surface to prevent the latch configurations from rotating about the threaded fastener.

29. An articulating bed comprising:

a sleep surface frame that is adapted to be articulated between fully raised and fully lowered positions;

a mounting member that is adapted to be supported by the bed;

a handle mount supported by the mounting member;

a plurality of latch configurations supported by the mounting member in a spaced relation to the handle mount; and an assist handle support for rotation by the handle mount, the plurality of latch configurations for latching the assist handle in a plurality of fixed positions relative to the bed.

* * * * *